US006115855A

United States Patent [19]

Lorenzo

[11] Patent Number: 6,115,855

[45] Date of Patent: Sep. 12, 2000

[54] DISPOSABLE BIODEGRADABLE POTTY LINER

[76] Inventor: Myriam Di Lorenzo, 13-15 College Point Blvd., College Point, N.Y. 11356

[21] Appl. No.: 09/221,681

[22] Filed: Jan. 2, 1999

[51] Int. Cl.[7] ..... A47K 11/06

[52] U.S. Cl. ..... 4/484

[58] Field of Search ..... 4/452, 484

[56] References Cited

U.S. PATENT DOCUMENTS

| | | | |
|---|---|---|---|
| 2,093,168 | 9/1937 | Hamer | 4/245.3 X |
| 2,866,980 | 1/1959 | Huntington | 4/484 |
| 3,118,146 | 1/1964 | Dorey | 4/484 X |
| 3,383,712 | 5/1968 | Grant | 4/452 |
| 3,428,967 | 2/1969 | Hughes | 4/484 |
| 3,471,871 | 10/1969 | Nociti et al. | 4/484 |
| 3,475,767 | 11/1969 | Friesen et al. | 4/452 |
| 3,495,278 | 2/1970 | Peters | 4/484 |
| 4,882,794 | 11/1989 | Stewart | 4/452 X |

*Primary Examiner*—Charles E. Phillips
*Attorney, Agent, or Firm*—Michael I. Knoll

[57] ABSTRACT

The present invention discloses a potty liner 10 comprised of flexible material which is inserted into a child training potty 12 and is intended for use by humans 14. The flexible liner 10 has a hole 22 therein through which the handle 18 of the potty 12 can be inserted for easy removal from the potty. The potty liner 10 is further equipped with means for closing 24 the liner 10 near its neck and the means further comprise hook and loop fastening means 26. A layer of the flexible liner 10 is made of permeable material 28 having an inner absorbing layer 30 sandwiched in between the permeable material 28 and the outer non-permeable layer 32.

1 Claim, 5 Drawing Sheets

DISPOSABLE BIODEGRADABLE POTTY LINER

BACKGROUND OF THE INVENTION

Field of the Invention

The present invention relates generally to disposable liners and, more specifically, to a disposable biodegradable liner which is inserted into a potty seat, used for toilet training infants, and is held in place by an elastic band located around the opening of the liner and placed circumventially outside of the potty until such time that the potty has been used wherein the liner is removed from the potty and the tab, located on the exterior surface of the liner and having a length of hook and loop material located on each side of the tab, will be drawn around the liner thereby forming a non-permeable container for the disposal of the urine and or fecal material.

DESCRIPTION OF THE PRIOR ART

There are a number of liners designed for bodily waste. Typical of these patents is U.S. Pat. No. 4,759,086 issued to Booth-Cox on Jul. 26, 1988.

Another patent was issued to Dehaese on Jul. 23, 1991 as 5,033,130. Yet another U.S. Pat. No. 4,899,399 was issued to Young on Feb 13, 1990.

Still another U.S. Pat. No. 5,455,972 was issued to Williams on Oct. 10, 1995.

A disposable receptacle for receiving bodily waste, comprising of a fluid permeable inner layer and an impermeable outer layer, with an absorbent outer layer, with an absorbent layer in between, and a rim portion with fastening means to attach the receptacle so it depends downwardly through the hole in a bed pan support or toilet trainer.

A protective cover for bedpans or the like comprises two sheets of paper, each waterproofed on one face with polyethylene. The sheets are superimposed one upon the other, waterproofed sides together, and the edges of the sheets are bonded together along a major portion of their perimeter. The unbonded portion of the perimeter of the sheets is of a size sufficient to extend over the edges surrounding the opening of a bedpan or the like. Elasticized thread is stitched to the edges of the unbonded portion of the perimeter for fitting and securing the cover over the external walls of the receiver and temporarily securing the sheets against motion with respect to the bedpan. A band of pressure sensitive adhesive is affixed to at least one sheet adjacent to the unbonded portion of the perimeter of the sheet for sealing the sheets together after use, thereby confining and retaining the dejecta within the protective cover This invention is an inflatable bedpan apparatus and method whereby an inflatable torus is mounted to a liquid-impervious base sheet. The torus is placed under the pelvis of a bed-ridden patient and inflated to create a waste collection reservoir on the base sheet. An end of the base sheet is secured at the inside bottom of a waste disposal bas so that the base sheet can be pulled into the waste disposal bag while the mouth of the waste disposal bag is held stationary. The inflatable torus includes an inflation system from a pressure vessel and a deflation port.

A bag constructed from synthetic plastic material which is impervious to liquid and other human waste has a pouch bonded to an exterior surface. The pouch has a wall remote from the surface of the bag which is constructed from a material which may be permeated by liquid. Liquid absorbing crystals are disposed between the wall and the surface of the bag. A bed pan may be positioned within the bag and the pouch pushed into the well of the bed pan. Human waste may be deposited onto the surface of the bag and the pouch in conventional manner, and thereafter the bag is turned inside-out as it is removed from the bed pan so that the waste remains within the interior of the inverted bag. The entry into the bag may thereafter be tied closed. The bed pan thus remains free of contact with the waste and need not be cleaned.

While these patents may be suitable for the purposes for which they were designed, they would not be as suitable for the purposes of the present invention, as hereinafter described.

SUMMARY OF THE PRESENT INVENTION

The present invention relates generally to disposable liners and, more specifically, to a disposable biodegradable liner which is inserted into a potty seat, used for toilet training infants, and is held in place by an elastic band located around the opening of the liner and placed circumventially outside of the potty until such time that the potty has been used wherein the liner is removed from the potty and the tab, located on the exterior surface of the liner and having a length of hook and loop material located on each side of the tab, will be drawn around the liner thereby forming a non-permeable container for the urine and or fecal material.

A primary object of the present invention is to provide a liner which can be placed inside a potty used for toilet training children.

Another object of the present invention is to provide a liner with an elastic band so that the liner may be used with potties of varying shapes and sizes.

A still further object of the present invention is to provide a liner with a means of closure which will prevent spillage of the contents.

A yet further object of the present invention is to provide a sanitary means for disposal of human waste wherein health issues, such as in day care centers, are of concern.

A still further object of the present invention is to prevent the user from having to empty and wash the potty after use.

Additional objects of the present invention will appear as the description proceeds.

The present invention overcomes the shortcomings of the prior art by providing a biodegradable liner which is easy to use and cheap to manufacture and eliminates the handling and washing of potty containers.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views.

Figure 1:
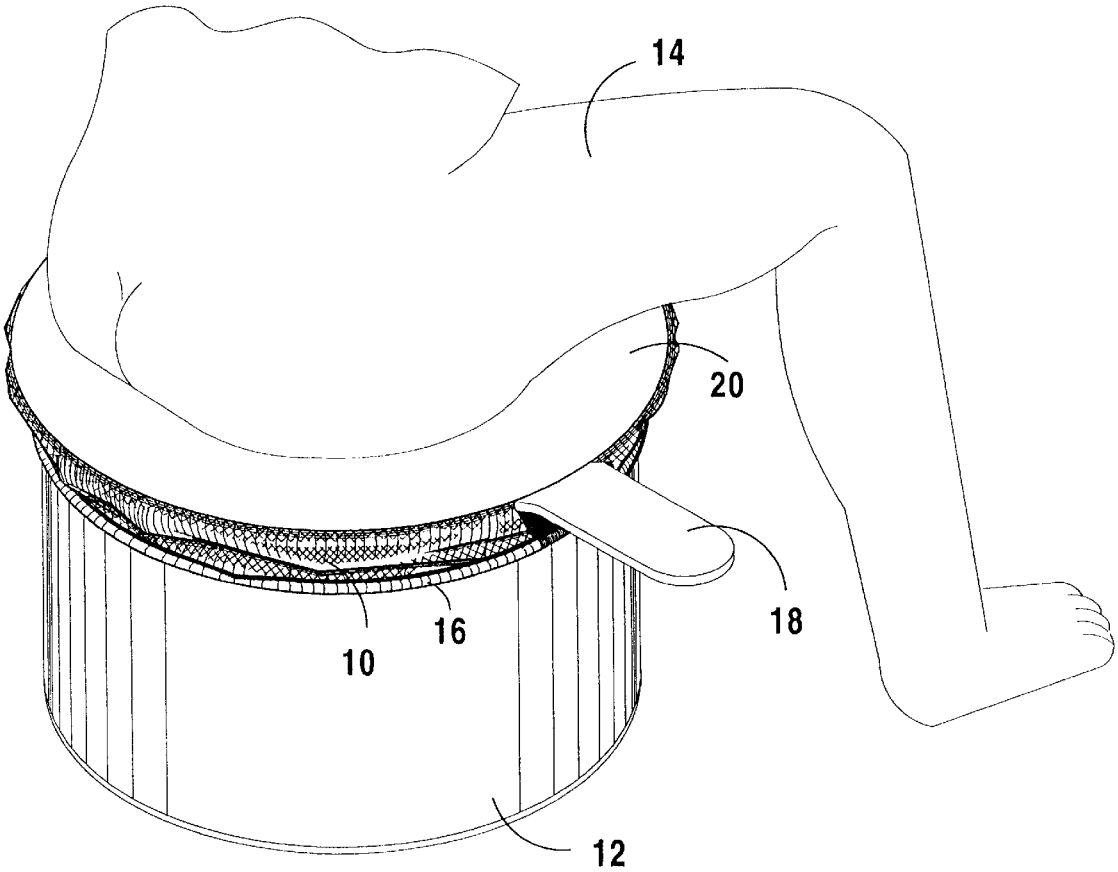
FIG. 1 is a perspective view of the preferred embodiment of the present invention in use. Shown is the present invention installed into a typical toilet training potty.

With regard to the reference numerals, the following numbering is used throughout the various drawings.

10 potty liner
12 potty
14 human
16 elastic rim member
18 potty handle
20 seat for potty
22 hole for potty handle
24 closure means
26 hook and loop fastening means
28 permeable layer
30 absorbent layer
32 non-permeable layer

DESCRIPTION OF THE PREFERRED EMBODIMENT(S)

Turning to FIG. 1, therein is shown the present invention in perspective view shown in operative connection and installed onto a typical toilet training potty and in use by a human. The flexible liner of the present invention with spaced apart walls is shown generally at 10 in operative connection with a typical toilet training potty 12 or other waste receiving vessel being in use by a human 14. Further shown therein is the elastic rim member 16 of the present invention along with the potty handle 18 and potty seat 20.

Figure 2:
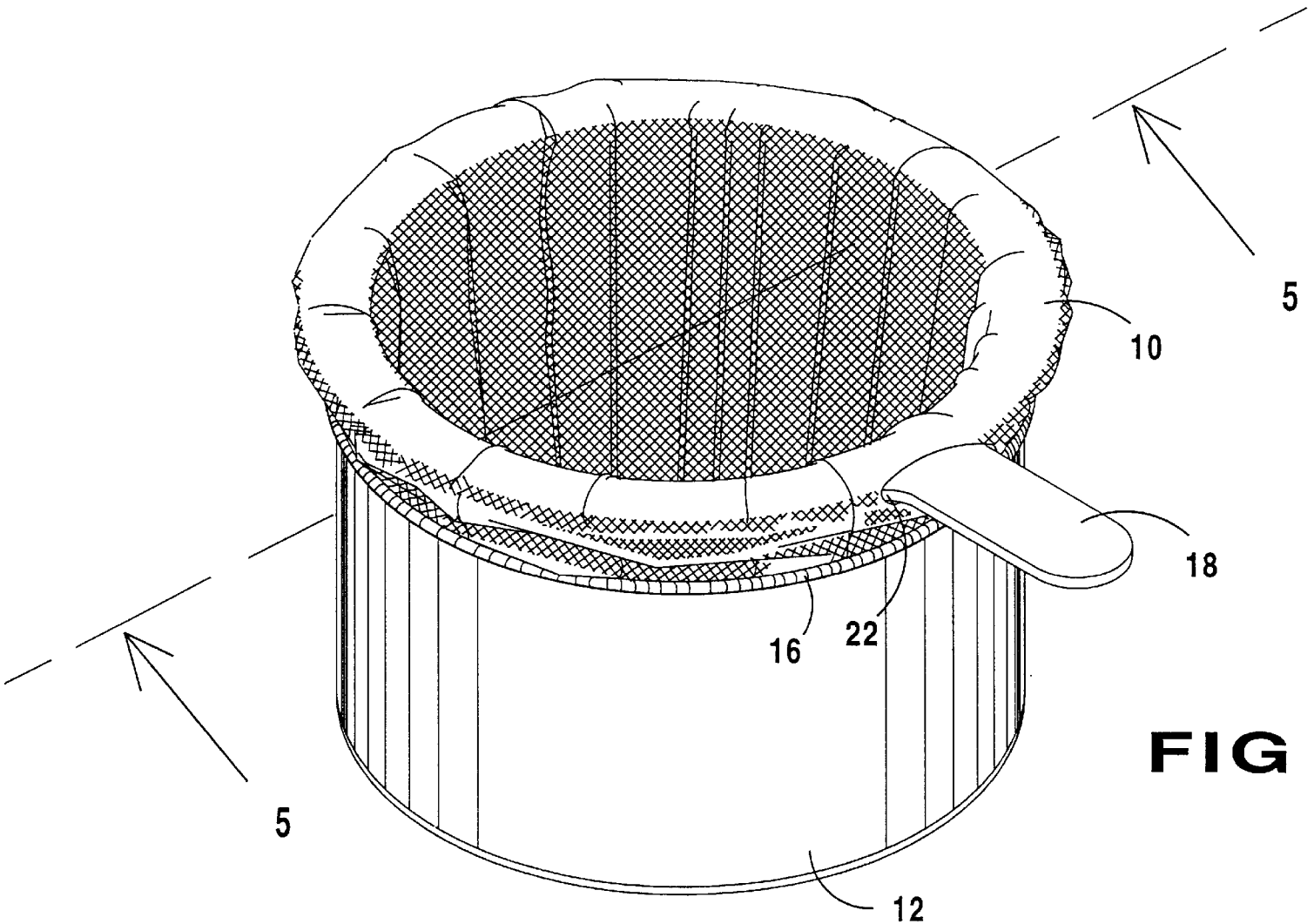
FIG. 2 is an exploded perspective view showing the liner installed into the potty and extending to the outside of the potty and being retained by the elastic member located around the opening of the liner.

Turning to FIG. 2, therein is shown an exploded perspective view showing the liner 10 with its open end installed onto the potty 12 and extending to the outside of the potty and being retained by the elastic member 16 located around the opening of the liner 10 with the closed end of the liner 10 being in the bottom of the potty 12. Also shown is the potty handle 18 and the potty liner 10 having a hole therein 22 through which the potty handle 18 is passed. It should be noted that the present invention 10 is intended for use with the types of potties in common use for potty training children and therefore is adaptable for use with many different types of potties. The elastic rim member 16 grips the potty 12 and allows the present invention 10 to be used with potties of varying sizes and shapes.

Figure 3:
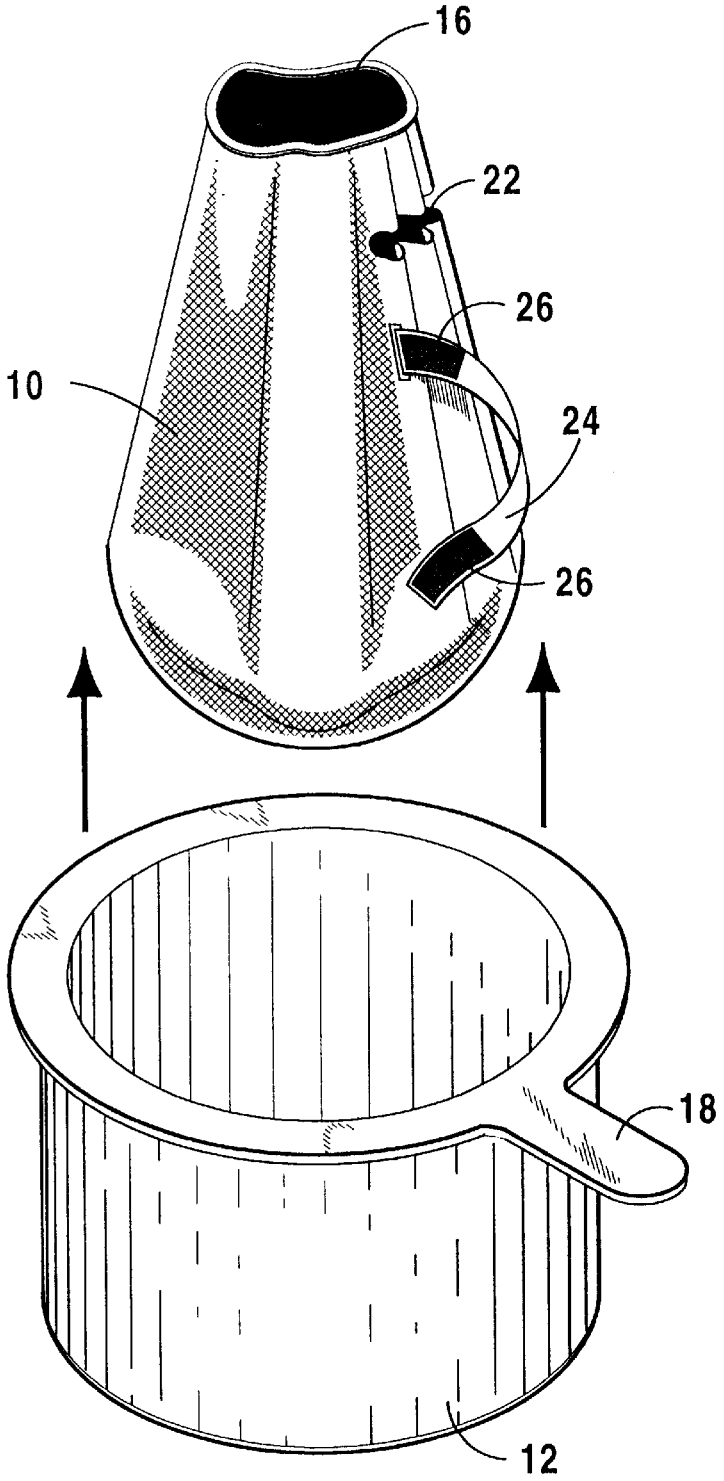
FIG. 3 is a perspective view of the present invention. Shown is the liner being removed from the potty after being used. Also shown is the tab which has hook and loop material attached to the tab as means for securing and maintaining the liner in a closed position.

Turning to FIG. 3, therein is shown the liner 10 being removed from the potty 12 after being used. Also shown is the tab 24 near the neck or open end of the liner 10 which tab 24 has hook and loop material 26 attached to the tab 24 as means for securing and maintaining the liner in a closed position. Also shown is the potty handle 18, the hole 22 through which the potty handle 18 passes, the rim of the potty liner 16, along with the tab or liner closure means 24 for tying off the liner 10 after it has been used. The closure means 24 is equipped with velcro or like fastening means 26 located on either end of and for securing the tab 24 firmly. After the liner 10 is secured and closed by the tab 24 and fastening means 26, no spillage of waste will occur. This therefore provides a sanitary means of holding human waste where this is necessary, such as day care centers, hospitals, etc. Likewise this maintains the potty in a clean condition so that it does not have to be cleaned after every usage.

Figure 4:
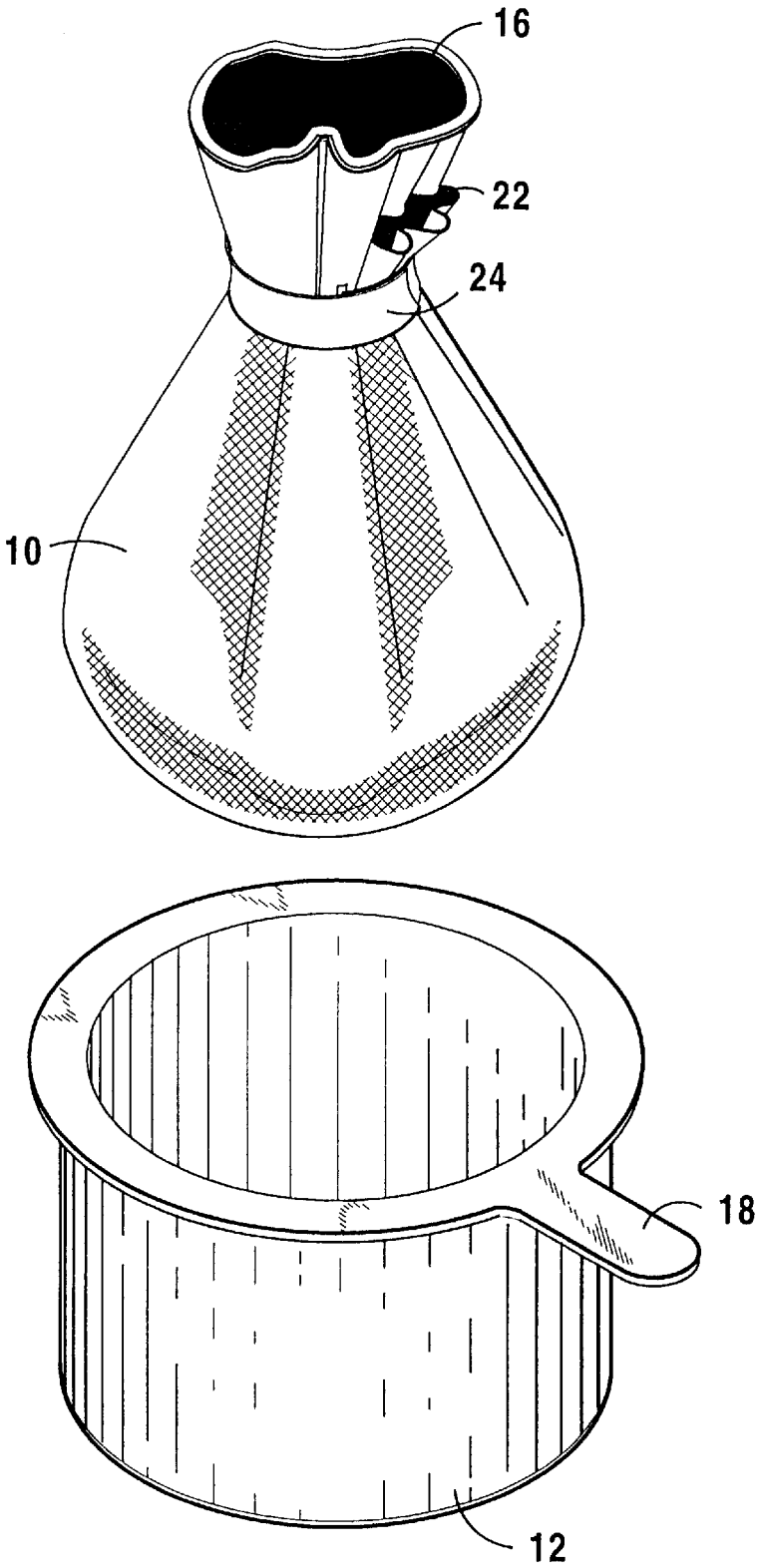
FIG. 4 is a perspective view of the present invention. Shown is the liner in a closed position using the tab as means for securing and maintaining the liner in a closed position.

Turning to FIG. 4, shown therein is the liner 10 in a closed position using the tab 24 as means for securing and maintaining the liner 10 in a closed position with the tab 24 tightly wrapped around the upper portion of the potty liner 10 and secured by the hook and loop material 26 (not shown). Also shown is the potty 12, the potty handle 18, the hole 22 through which the potty handle 18 passes, the elastic rim of the potty liner 16, along with tab or liner closure means 24 for tying off the liner. The closure means 24 may be equipped with velcro fastening means 26 (not shown) for securng the tab 24 firmly.

Figure 5:
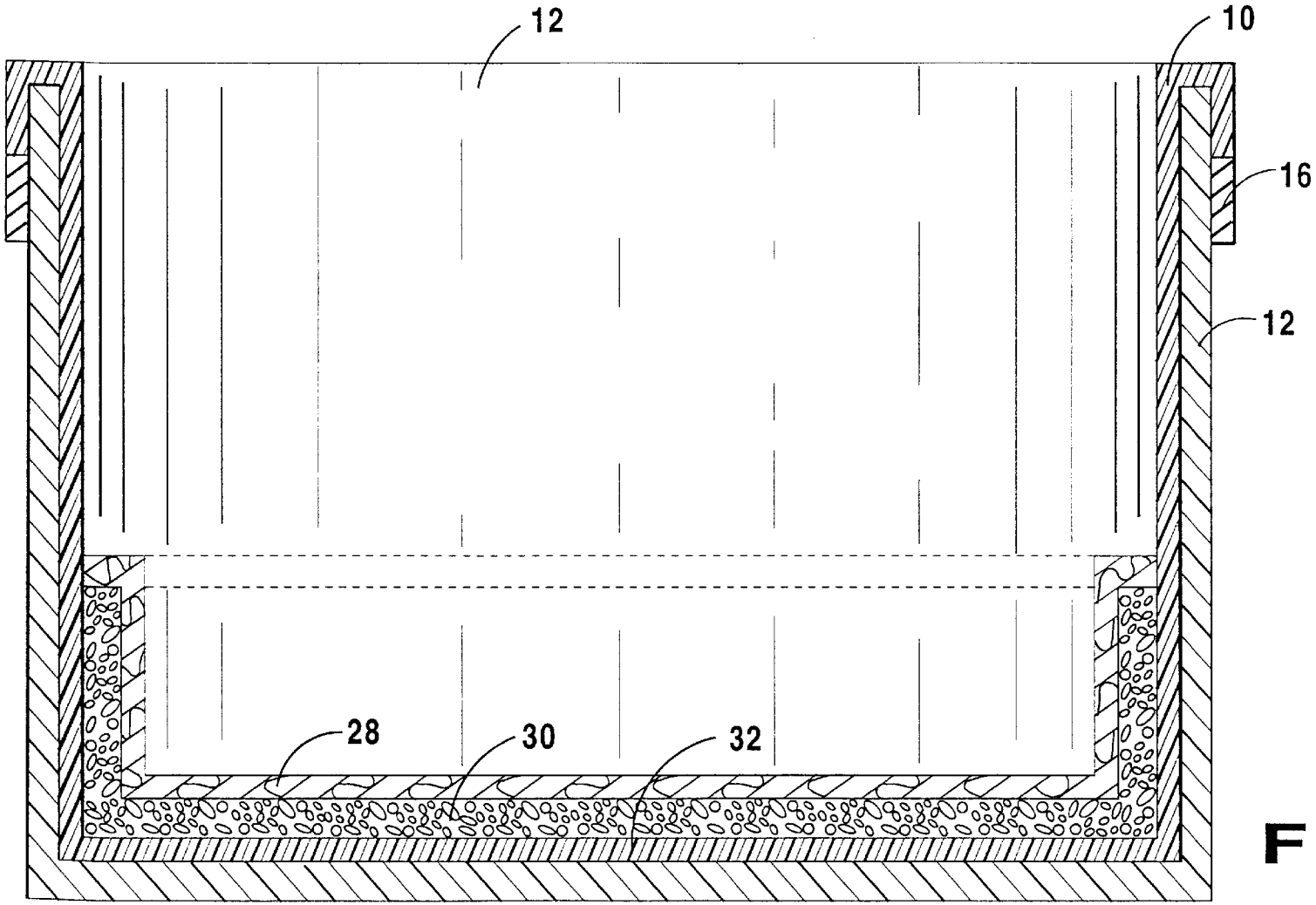
FIG. 5 is a cross sectional, taken from FIG. 2 as indicated, showing an absorbent paper layer, which may be a permeable plastic layer as well, covering a layer of absorbent material which will contain the liquid, the final exterior layer is a non permeable layer to contain all liquid and fecal material.

Turning to FIG. 5, therein is shown a cross-sectional view, taken from FIG. 2. Shown therein is the potty liner 10, the elastic rim of the potty liner 16, and the potty 12. Also shown therein is a permeable paper or plastic layer 28, an inner absorbent layer 30 of absorbent material which will absorb and contain the liquid waste material, along with the outer exterior layer of non-permeable material 32 which is coexistent with the layer 10 which will contain all waste material both liquid and solid.

I claim:

1. A flexible liner in combination with a child training potty, comprising:

a. a waste receiving bag having spaced apart walls for holding human waste;

b. said bag further having an open end with an elastic rim and a closed end;

c. said closed end of said bag being inserted into said child training potty, said potty having a closed bottom and an open top having an overhanging rim with a flat handle extending horizontally from said rim;

d. said open end of said bag being wrapped around the top of said child training potty;

e. said elastic rim stretched over the overhanging rim of said child training potty;

f. said bag comprising a material impervious to human wastes and made up of a permeable inner layer, a non permeable outer layer, and an absorbent layer between the inner and outer layers;

g. said bag having closure means locked near its open end comprising hook and loop material means whereby said bag can be effectively closed to prohibit leakage of waste material from said bag; and h. said bag having a hole therein located above said liner closure means receiving said handle of the training potty.

* * * * *